US007197882B2

(12) United States Patent
Marnas et al.

(10) Patent No.: US 7,197,882 B2
(45) Date of Patent: Apr. 3, 2007

(54) TURBOJET DIFFUSER

(75) Inventors: Laurent Marnas, Vaux le Penil (FR); Christophe Pieussergues, Nangis (FR); Pierre Sablayrolles, Paris (FR); Denis Trahot, Ermont (FR)

(73) Assignee: Snecma Moteurs, Paris (FR)

( * ) Notice: Subject to any disclaimer, the term of this patent is extended or adjusted under 35 U.S.C. 154(b) by 168 days.

(21) Appl. No.: 11/039,887

(22) Filed: Jan. 24, 2005

(65) Prior Publication Data

US 2005/0172632 A1 Aug. 11, 2005

(30) Foreign Application Priority Data

Feb. 5, 2004 (FR) ..... 04 01084

(51) Int. Cl.
*F02C 7/00* (2006.01)

(52) U.S. Cl. ..... 60/796; 60/751; 415/207

(58) Field of Classification Search ..... 60/751, 60/752, 796, 799, 800; 415/207
See application file for complete search history.

(56) References Cited

U.S. PATENT DOCUMENTS

| | | | | |
|---|---|---|---|---|
| 2,445,661 | A | 7/1948 | Constant et al. | |
| 5,592,821 | A * | 1/1997 | Alary et al. | 60/751 |
| 2002/0092303 | A1 * | 7/2002 | Al-Roub et al. | 60/751 |

FOREIGN PATENT DOCUMENTS

| | | |
|---|---|---|
| EP | 0 523 935 | 1/1993 |

* cited by examiner

*Primary Examiner*—L. J. Casaregola
(74) *Attorney, Agent, or Firm*—Oblon, Spivak, McClelland, Maier & Neustadt, P.C.

(57) ABSTRACT

A turbojet diffuser disposed between a compressor and a combustion chamber, and secured to an outer upstream annular flange of an outer casing of the combustion chamber by suspension means which comprise a first frustoconical wall extending from the outer longitudinal wall of the diffuser towards the combustion chamber, and a second frustoconical wall extending towards the compressor between the first frustoconical wall and the outer casing of the combustion chamber.

20 Claims, 2 Drawing Sheets

-10-
-2-
-3-
11
16
15
18
35
17
12
14
28
9
13
34
38
37
33
30
31
29
32
36
4
8
5
6
7

TURBOJET DIFFUSER

The present invention relates to a turbojet diffuser, the diffuser being disposed between a compressor and a combustion chamber in the turbojet.

BACKGROUND OF THE INVENTION

In the prior art, the diffuser is often secured inside an outer casing of the combustion chamber by a thin wall or web of frustoconical shape which extends from an outer longitudinal wall of the diffuser towards the combustion chamber, and which is welded at its radially outer end to the outer casing of the combustion chamber.

The drawback of that prior art is that the diffuser, which has a lifetime that is considerably shorter than that of the combustion chamber casing, is not separable from the casing.

It is therefore desirable to secure the diffuser in removable manner to the outer casing of the combustion chamber. In order to make it easier to remove the diffuser, a better technique would be to secure it by means of an outer annular flange inserted between the annular flanges for coupling together the outer casings of the compressor and of the combustion chamber.

For that purpose, it would be necessary for a diffuser-fastening frustoconical wall or web to extend from the diffuser towards the compressor. Nevertheless, that is not possible because of constraints associated with taking air from the compressor, whereby an annular space formed around the stator of the compressor extends downstream to the vicinity of the upstream portion of the diffuser and is defined by a transverse wall that is secured to the outer casing of the compressor and that constitutes an obstacle in this location against receiving a diffuser-fastening frustoconical wall or web extending from the diffuser towards the compressor.

That problem might be solved by means of structural arms connected to the outer longitudinal wall of the diffuser downstream from the stator blades, but that would require the diffuser to be made in two parts, which would complicate manufacture and increase its cost.

OBJECTS AND SUMMARY OF THE INVENTION

A particular object of the invention is to provide a solution that is simple, economical, and inexpensive to the problem of separably securing the diffuser in a turbojet.

To this end, the invention provides a turbojet diffuser disposed between a compressor and a combustion chamber, and secured to an outer casing of the combustion chamber by suspension means extending between the outer casing and an outer longitudinal wall of the diffuser, wherein the suspension means comprise a first frustoconical wall extending from the outer longitudinal wall of the diffuser towards the combustion chamber, and a second frustoconical wall connected to the first frustoconical wall and extending towards the compressor between the first frustoconical wall and the outer casing of the combustion chamber.

The two frustoconical diffuser-fastening walls of the invention serve to get round the downstream extent of the annular space surrounding the compressor, and thus to secure the diffuser to the outer casing of the combustion chamber without changing the specifications for taking air from the compressor, and without using structural arms.

Advantageously, the second frustoconical wall is secured to the outer casing of the combustion chamber at the connection between the outer casings of the compressor and of the combustion chamber in particularly simple manner by inserting an annular flange on the above-mentioned second frustoconical wall between the annular connection flanges of the casings of the compressor and of the annular chamber.

This also makes it possible for the first frustoconical wall of the suspension means to be connected to the upstream end of the outer longitudinal wall of the diffuser, thereby ensuring good alignment of the upstream end of the diffuser with the downstream end of the compressor, so that a step of stator blades at the upstream end of the diffuser is properly positioned and centered on the axis of the compressor.

In addition, the two-cone shape of the suspension means increases the flexibility of the diffuser mounting and reduces stresses at the connection with the outer longitudinal wall of the diffuser, thereby increasing its lifetime.

The two frustoconical walls or webs of the suspension means are made as a single piece and the junction between them comprises an annular rib extending towards the combustion chamber. This annular rib stiffens the junction zone between the two frustoconical walls or webs and distributes the stresses in this zone. Its thickness lies preferably in the range 1.3 to 1.7 times the thickness of the webs, and its optimal thickness is equal to about 1.5 times the thickness of the webs.

In its simplest embodiment, this rib is in the form of a cylinder centered on the axis of the turbojet.

In a variant, it may extend in line with the bisector of the angle formed between the two frustoconical walls or webs of the diffuser suspension means.

In general, an advantage of the diffuser of the invention is that it is simple to dismount while complying with specifications for taking air from the compressor.

BRIEF DESCRIPTION OF THE DRAWINGS

Other advantages and characteristics of the invention appear on reading the following description made by way of non-limiting example and with reference to the accompanying drawings, in which.

MORE DETAILED DESCRIPTION

Figure 1:
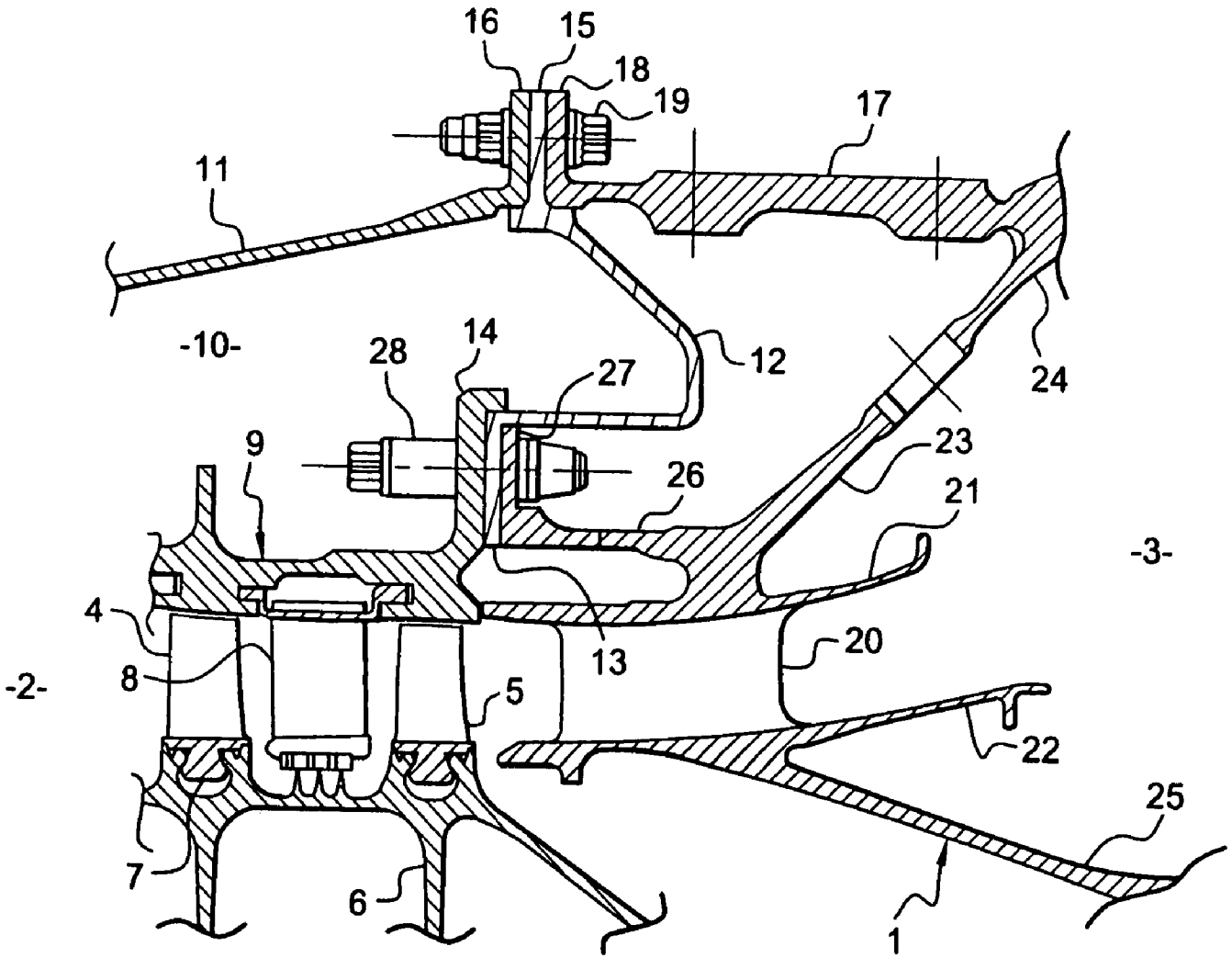
FIG. 1 is a diagrammatic fragmentary axial section view of the last stage of a high pressure compressor and a diffuser in a prior art turbojet.

In the drawings, the left-hand side is upstream or towards the front of the turbojet and the right-hand side is downstream or towards the rear.

In FIG. 1, reference 1 designates a prior art diffuser arranged between an upstream compressor 2 and a downstream combustion chamber 3 in a turbojet.

The compressor 2 is a high pressure compressor and comprises a plurality of stages of moving blades 4, 5 mounted on a rotor 6 of the turbojet by appropriate means 7, e.g. of the dovetail type, and stages of nozzle-forming stationary blades 8 mounted on a stator 9 of the turbojet by appropriate means. In FIG. 1, there are shown only two stages of moving blades 4 and 5 and one stage of stationary blades 8 disposed between the two stages of moving blades 4 and 5.

An annular space 10 is defined around the stator 9 of the compressor 2 by an outer casing 11 and by a rear transverse wall 12 which is mounted by means of an inner annular flange 13 to an annular flange 14 of the stator 9 and by an outer annular flange 15 to an annular flange 16 of the outer casing 11 of the compressor 2.

The combustion chamber 3 is defined by an outer casing 17 and by an inner casing (not shown), the outer casing 17 being secured at its upstream end to the outer casing 11 of the compressor 2 by means of an annular flange 18 pressed against the outer annular flange 15 of the transverse wall 12 of the compressor 2, the three flanges being fastened together by appropriate means of the nut-and-bolt type 19.

Because of constraints associated with taking air from the compressor 2, the rear transverse wall 12 extends downstream around an upstream portion of the diffuser 1.

The diffuser 1 has stationary blades 20 disposed radially between an outer longitudinal wall 21 and an inner longitudinal wall 22 for guiding the air leaving the compressor 2 towards a combustion chamber 3.

The diffuser 1 is secured to the inside of the outer casing 17 of the combustion chamber 3 by a thin wall or web 23 of frustoconical shape that extends from the outer longitudinal wall 21 of the diffuser 1 towards the combustion chamber 3 and that is welded at its radially outer end 24 to the outer casing 17 of the combustion chamber 3. The frustoconically-shaped wall or web 23 is attached to the outer longitudinal wall 21 of the diffuser in the middle portion of said wall 21. The diffuser 1 is also secured via an inner wall or web 25 of frustoconical shape that extends from the inner longitudinal wall 22 of the diffuser 1 towards the combustion chamber 3 to an inner casing (not shown) of the combustion chamber. In addition, a cylindrical wall 26 extends from the outer longitudinal wall 21 of the diffuser 1 towards the compressor 2 and is secured to the stator 9 of the compressor 2 by means of an annular flange 27 pressed against the connection flanges 14 and 13 of the stator 9 and of the transverse wall 12 of the compressor 2, respectively, with fastening being provided by appropriate means 28 of the nut-and-bolt type.

The above prior art diffuser cannot be removed independently of the casings of the combustion chamber.

Figure 2:
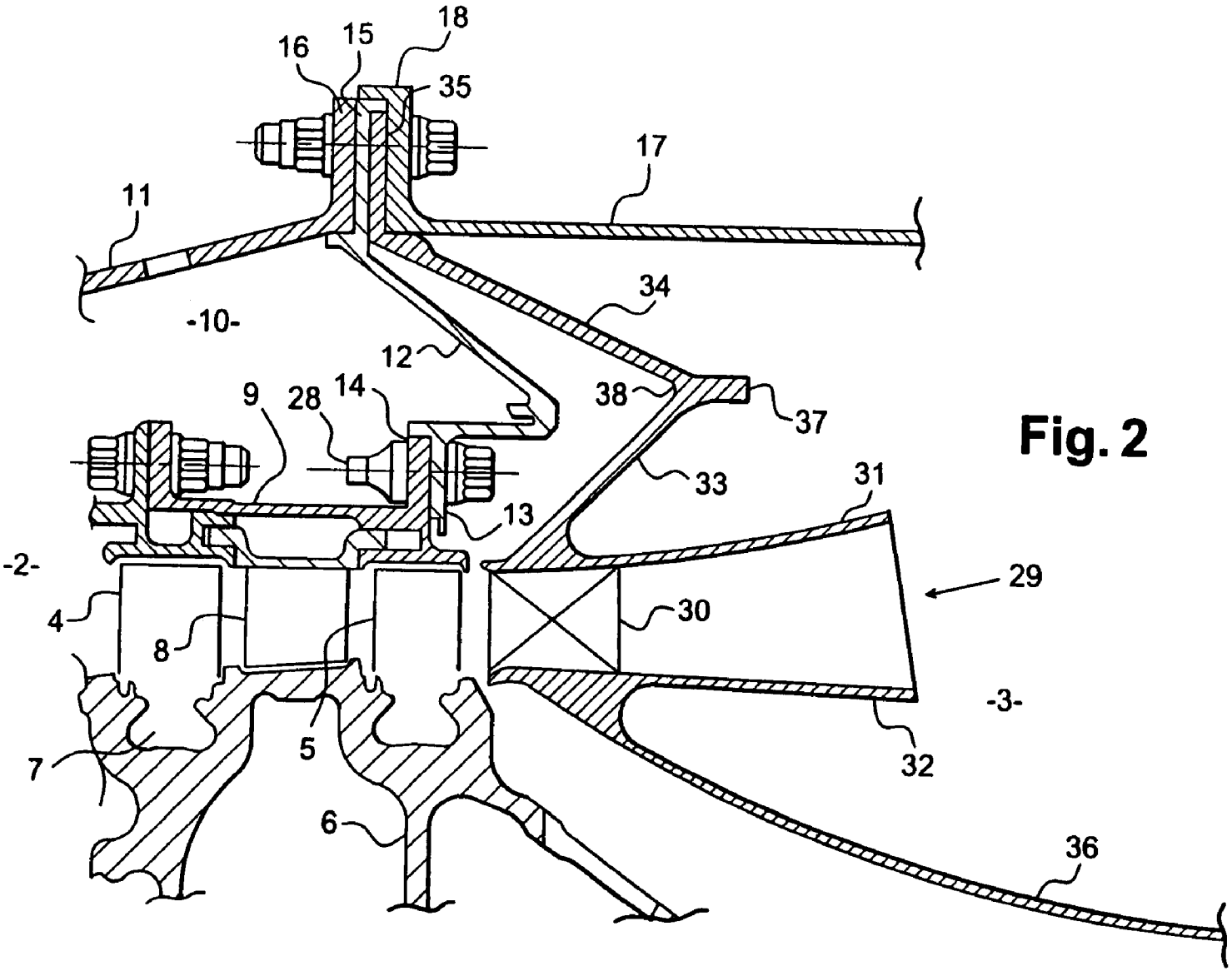
FIG. 2 is a diagrammatic fragmentary axial section view of the last stage of a high pressure compressor and the diffuser of the invention.

FIG. 2 shows a diffuser 29 of the present invention arranged between a compressor 2 and a combustion chamber 3 of the same types as those described above.

The diffuser 29 has stationary blades 30 disposed radially between its outer longitudinal wall 31 and its inner longitudinal wall 32 to guide the air leaving the compressor 2 towards the combustion chamber 3.

The diffuser 29 is mounted inside the outer casing 17 of the combustion chamber 3 by suspension means that comprise a first wall or web 33 of frustoconical shape extending from the outer longitudinal wall 31 of the diffuser 29 towards the combustion chamber 3 and a second wall or web 34 of frustoconical shape extending between the first frustoconical wall 33 and the outer casing 17 of the combustion chamber 3 towards the compressor 2 and terminating in an outwardly-directed outer annular flange 35 clamped between the coupling flange 15 of the traverse wall 12 of the compressor 2 and the upstream flange 18 of the outer casing of the combustion chamber 3, the annular flange 16 of the compressor casing being pressed against the annular flange 15 of the transverse wall 12. The diffuser 29 also comprises an inner wall or web 36 of frustoconical shape extending from the inner longitudinal wall 32 of the diffuser 29 towards the combustion chamber 3 and secured at its downstream end (not shown) to the inner casing of the combustion chamber 3.

The two frustoconical walls or webs 33 and 34 of the suspension means are formed as a single part and their junction comprises an annular rib 37 extending towards the combustion chamber 3 and serving to stiffen the junction zone between the two walls 33 and 34 and to distribute stresses in this zone.

The annular rib 37 is of a thickness lying in the range 1.3 to 1.7 times the thickness of the webs 33 and 34, and preferably equal to approximately 1.5 times the thickness of the webs 33 and 34.

By way of example, this annular rib 37 is cylindrical in shape and centered on the axis (not shown) of the turbojet. In a variant, it extends along the bisector of the angle formed between the two frustoconical walls or webs 33 and 34 of the suspension means.

The radius of curvature of the connection 38 between the surfaces on the upstream side of the two frustoconical walls 33 and 34 is equal to about three millimeters, for example.

These two frustoconical walls 33 and 34 surround the downstream projection of the transverse wall 12 of the compressor 2, thereby enabling the first frustoconical wall 33 of the suspension means to be connected to the upstream end of the outer longitudinal wall 31 of the diffuser 29, thus improving the stability and the alignment of the stationary blades 30 relative to the compressor 2.

What is claimed is:

1. A turbojet diffuser disposed between a compressor and a combustion chamber, the diffuser being independent from the compressor and secured to an outer casing of the combustion chamber by only one suspension element extending between the outer casing and an outer longitudinal wall of the diffuser, wherein said suspension element is constituted by a first frustoconical wall extending from the outer longitudinal wall of the diffuser towards the combustion chamber, and a second frustoconical wall connected to the first frustoconical wall and extending towards the compressor between the first frustoconical wall and the outer casing of the combustion chamber.

2. A diffuser according to claim 1, wherein the two frustoconical walls are formed as a single part.

3. A diffuser according to claim 1, wherein the second frustoconical wall includes an outwardly-directed outer annular flange for fastening to an upstream annular flange of the outer casing of the combustion chamber.

4. A diffuser according to claim 3, wherein the outwardly-directed radially outer annular flange of the second frustoconical wall is clamped between an annular end flange of an outer casing of the compressor and the upstream annular flange of the outer casing of the combustion chamber.

5. A diffuser according to claim 1, wherein the junction between the two frustoconical walls includes an annular rib extending towards the combustion chamber.

6. A diffuser according to claim 5, wherein the annular rib is of cylindrical shape centered on the axis of rotation of the compressor.

7. A diffuser according to claim 5, wherein the annular rib extends along the bisector of the angle formed by the two frustoconical walls.

8. A diffuser according to claim 5, wherein the thickness of the annular rib lies in the range 1.3 to 1.7 times the thickness of the frustoconical walls.

9. A diffuser according to claim 8, wherein the thickness of the annular rib is equal to about 1.5 times the thickness of the frustoconical walls.

10. A diffuser according to claim 1, wherein the first frustoconical wall is connected to the upstream end of the outer longitudinal wall of the diffuser.

11. A diffuser according to claim 1, wherein the radius of curvature of the connection between the surfaces on the upstream side of the two frustoconical walls is about three millimeters.

12. A turbojet comprising a diffuser according to claim 1.

13. A single piece turbojet diffuser adapted to be disposed between a compressor and a combustion chamber and secured to an outer casing of the combustion chamber, said single piece turbojet diffuser comprising:

an inner longitudinal wall having an upstream end adapted to be disposed nearer the compressor and a downstream end adapted to be disposed nearer the combustion chamber;

an outer longitudinal wall having an upstream end adapted to be disposed nearer the compressor and a downstream end adapted to be disposed nearer the combustion chamber;

wherein the upstream ends of the inner and outer longitudinal walls are spaced apart by a first distance and the downstream ends of the inner and outer longitudinal walls are spaced apart by a second distance greater than the first distance to thereby diffuse gas flowing between the inner and outer longitudinal walls; and a suspension element extending from the upstream end of the outer longitudinal wall and adapted to be secured to the outer casing of the combustion chamber, wherein said suspension element comprises a first frustoconical wall extending outwardly from the upstream end of the outer longitudinal wall in a downstream direction, and a second frustoconical wall connected to the first frustoconical wall and extending outwardly therefrom in an upstream direction.

14. A single piece turbojet diffuser according to claim 13, wherein the second frustoconical wall includes an outwardly-directed outer annular flange adapted for fastening to an upstream annular flange of the outer casing of the combustion chamber.

15. A single piece turbojet diffuser according to claim 13, wherein the junction between the two frustoconical walls includes an annular rib extending in a downstream direction.

16. A single piece turbojet diffuser according to claim 15, wherein the thickness of the annular rib lies in the range 1.3 to 1.7 times the thickness of the frustoconical walls.

17. A single piece turbojet diffuser according to claim 16, wherein the thickness of the annular rib is equal to about 1.5 times the thickness of the frustoconical walls.

18. A turbojet diffuser disposed between a compressor and a combustion chamber, and secured to an outer casing of the combustion chamber by a suspension element extending between the outer casing and an outer longitudinal wall of the diffuser, wherein said suspension element comprises a first frustoconical wall extending from the outer longitudinal wall of the diffuser towards the combustion chamber, and a second frustoconical wall connected to the first frustoconical wall and extending towards the compressor between the first frustoconical wall and the outer casing of the combustion chamber, wherein the second frustoconical wall includes an outwardly-directed outer annular flange for fastening to an upstream annular flange of the outer casing of the combustion chamber.

19. A turbojet diffuser according to claim 18, wherein the outwardly-directed radially outer annular flange of the second frustoconical wall is clamped between an annular end flange of an outer casing of the compressor and the upstream annular flange of the outer casing of the combustion chamber.

20. A turbojet diffuser disposed between a compressor and a combustion chamber, and secured to an outer casing of the combustion chamber by a suspension element extending between the outer casing and an outer longitudinal wall of the diffuser, wherein said suspension element comprises a first frustoconical wall extending from the outer longitudinal wall of the diffuser towards the combustion chamber, and a second frustoconical wall connected to the first frustoconical wall and extending towards the compressor between the first frustoconical wall and the outer casing of the combustion chamber, wherein the junction between the two frustoconical walls includes an annular rib extending towards the combustion chamber along the bisector of the angle formed by the two frustoconical walls.

* * * * *